US009533510B2

(12) United States Patent
Begeal et al.

(10) Patent No.: US 9,533,510 B2
(45) Date of Patent: Jan. 3, 2017

(54) CONNECTOR FOR SUPPLYING FLUID TO A PRINT SYSTEM

(71) Applicants: Carlton E. Begeal, Golden, CO (US); Dilan Nirushan Fernando, Thornton, CO (US); Sean K. Fitzsimons, Thornton, CO (US); William E. Manchester, Erie, CO (US)

(72) Inventors: Carlton E. Begeal, Golden, CO (US); Dilan Nirushan Fernando, Thornton, CO (US); Sean K. Fitzsimons, Thornton, CO (US); William E. Manchester, Erie, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/714,087

(22) Filed: May 15, 2015

(65) Prior Publication Data

US 2016/0332452 A1 Nov. 17, 2016

(51) Int. Cl.
*B41J 2/175* (2006.01)

(52) U.S. Cl.
CPC ..... *B41J 2/17526* (2013.01); *B41J 2/17543* (2013.01); *B41J 2/17546* (2013.01)

(58) Field of Classification Search
CPC ... B41J 2/17523; B41J 2/17526; B41J 2/1753; B41J 2/17543; B41J 2/17546
See application file for complete search history.

(56) References Cited

U.S. PATENT DOCUMENTS 6,649,829 B2 11/2003 Garber et al.
7,467,862 B2 12/2008 Kawamura et al.
7,984,980 B2 7/2011 Kachi
8,075,117 B2 12/2011 Steinmetz et al.
8,627,860 B2 1/2014 Ferguson et al.
(Continued)

FOREIGN PATENT DOCUMENTS

EP 0789322 A2 8/1997
EP 0872347 A1 10/1998
(Continued)

OTHER PUBLICATIONS

Partial European Search Report; EP16168769; Oct. 4, 2016.

*Primary Examiner* — Julian Huffman
*Assistant Examiner* — Sharon A Polk
(74) *Attorney, Agent, or Firm* — Duft Bornsen & Fettig LLP

(57) ABSTRACT

Systems and methods for connector for supplying fluid to a print system. One system is an apparatus that includes a fluid supply station of a printer with a connector to couple with a fluid source for supplying fluid to at least one printhead of the printer. The connector includes an interface having a body with an end surface that corresponds with a face of a nozzle of the fluid source. The connector also includes an inlet protruding from the end surface and configured to enter an opening of the nozzle for receiving the fluid from the fluid source. The connector further includes communication circuitry disposed on the end surface and configured to establish a connection with corresponding communication circuitry disposed on the face of the nozzle of the fluid source when the inlet enters the opening of the nozzle and the end surface and the nozzle face align.

19 Claims, 6 Drawing Sheets

(56) References Cited

U.S. PATENT DOCUMENTS

| | | | | |
|---|---|---|---|---|
| 8,764,173 | B2 * | 7/2014 | Haines | B41J 2/175 347/49 |
| 8,789,934 | B2 | 7/2014 | Chen et al. | |
| 8,833,912 | B2 | 9/2014 | Olsen | |
| 2011/0121024 | A1 | 5/2011 | Devos et al. | |
| 2013/0010038 | A1 | 1/2013 | Hayakawa et al. | |
| 2013/0314217 | A1 | 11/2013 | Zogg et al. | |
| 2014/0055537 | A1 | 2/2014 | Harvey et al. | |
| 2014/0176650 | A1 | 6/2014 | Maruyama et al. | |
| 2014/0210917 | A1 | 7/2014 | Kodama et al. | |

FOREIGN PATENT DOCUMENTS

| | | | | |
|---|---|---|---|---|
| EP | 0878307 | A2 * | 11/1998 | B41J 2/1752 |
| EP | 1527886 | A1 | 5/2005 | |

* cited by examiner

CONNECTOR FOR SUPPLYING FLUID TO A PRINT SYSTEM

FIELD OF THE INVENTION

The invention relates to the field of printing systems, and in particular, to a connector for supplying fluid to a print system.

BACKGROUND

Businesses or other entities having a need for volume printing typically use a production printer capable of printing hundreds of pages per minute. During printing, droplets of liquid ink are precisely ejected onto a print medium by rows of small nozzles located on each printhead. For proper print operation, each printhead has a reliable supply of ink supplied to its chamber.

Production inkjet printers typically make use of an ink container that is separated from the movement of printheads during printer operation. When the ink container is exhausted, it is removed and replaced with a new ink container. However, if the ink container is improperly seated in the printer, air may be introduced into the ink distribution channels, resulting in many hours of downtime of the printer to clean leaks and clear the channels.

SUMMARY

Embodiments described herein provide for a connector for ink supply in a print system. One embodiment is an apparatus that includes an ink supply station of a printer. The ink supply station includes a connector to couple with an ink container for supplying ink to at least one printhead of the printer. The connector includes an interface having a body with an end surface that corresponds with a face of a nozzle of the fluid source. The connector also includes an inlet protruding from the end surface and configured to enter an opening of the nozzle for receiving the fluid from the fluid source. The connector further includes communication circuitry disposed on the end surface and configured to establish a connection with corresponding communication circuitry disposed on the face of the nozzle of the fluid source when the inlet enters the opening of the nozzle and the end surface and the nozzle face align.

In a further embodiment, the apparatus includes a processor configured to analyze the connection, and to validate the fluid source based on the connection. In still a further embodiment, the apparatus includes a blocking mechanism communicatively coupled to the processor and configured to move to a first position to prevent the interface from retracting into the connector, and to move to a second position to allow the interface to retract into the connector. In response to a determination that the fluid source is valid, the processor is configured to direct the blocking mechanism to move to the second position to allow the interface to retract into the base of the connector so that the inlet contacts a valve in the nozzle and receives the fluid from the fluid source.

In yet a further embodiment, when the blocking mechanism is in the first position: the interface protrudes from a base of the connector in a forward horizontal direction, the inlet protrudes from the end surface in the forward horizontal direction for a first length, and the blocking mechanism is disposed in the base behind the interface to prevent the interface from retracting into the base along a path in a reverse horizontal direction. When the blocking mechanism is in the second position: the interface is able to retract into the base in the reverse horizontal direction, the inlet protrudes from the end surface in the forward horizontal direction for a second length that is longer than the first length by an amount that corresponds with an amount of retraction of the interface into the base, and the blocking mechanism is positioned in a vertical direction away from the path to allow the interface to retract into the base in the reverse horizontal direction.

Another embodiment is a fluid connector that includes a tubular body configured to slide with respect to a fixed base, and a blocking mechanism configured to move between a first position in the base behind the tubular body to prevent the tubular body from sliding, and a second position that allows the tubular body to slide into the base. The fluid connector also includes an end on one side of the tubular body, and an inlet extending from the end and configured to enter a nozzle of a fluid source for receiving fluid into the fluid connector. The fluid connector further includes communication circuitry disposed on the end around the inlet and configured to connect to corresponding communication circuitry disposed on an opposing surface of the fluid source; and a processor coupled to the communication circuitry and configured to direct movement of the blocking mechanism based on the connection.

The above summary provides a basic understanding of some aspects of the specification. This summary is not an extensive overview of the specification. It is not intended to identify key or critical elements of the specification nor to delineate any scope of particular embodiments of the specification, or any scope of the claims. Its sole purpose is to present some concepts of the specification in a simplified form as a prelude to the more detailed description that is presented later. Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
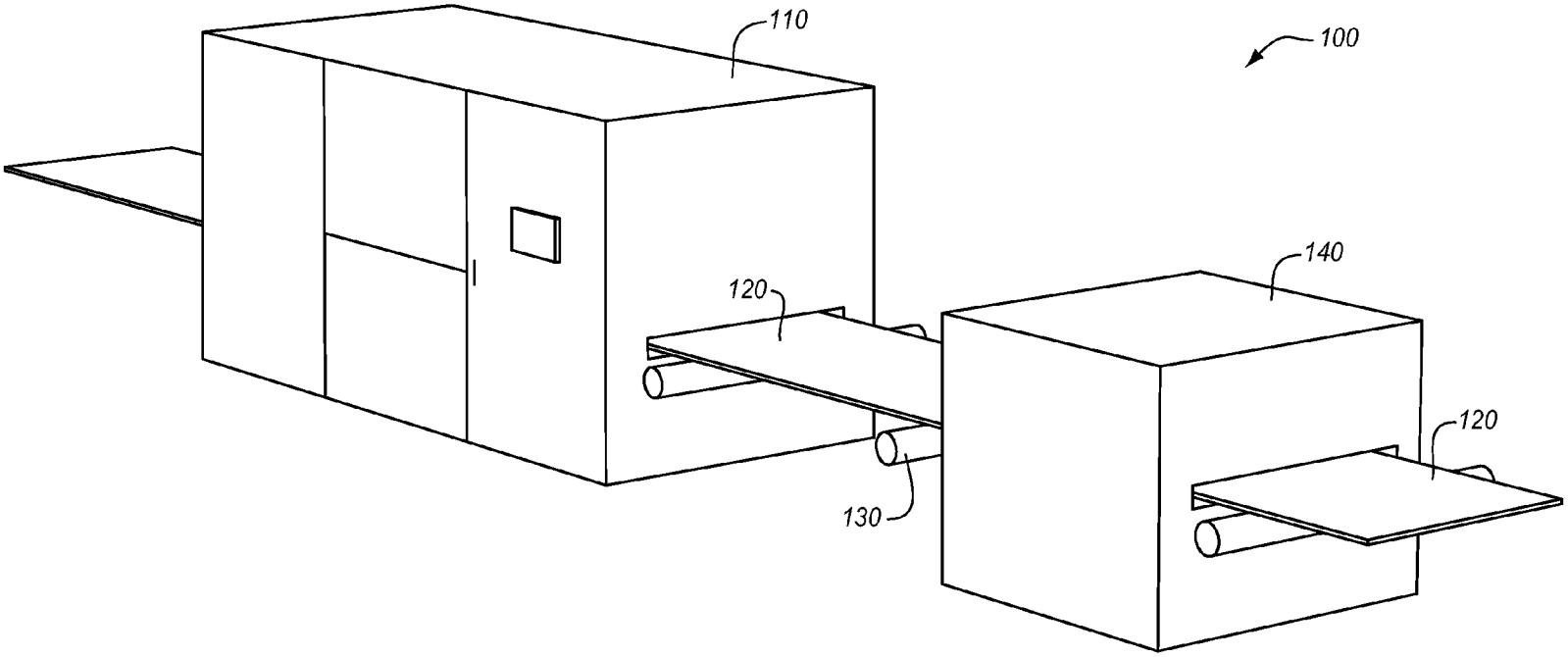
FIG. 1 illustrates an exemplary continuous-forms printing system.

FIG. 1 illustrates an exemplary continuous-forms printing system 100. Printing system 100 includes production printer 110, which is configured to apply ink onto a web 120 of continuous-form print media (e.g., paper). As used herein, the word "ink" is used to refer to any suitable marking fluid (e.g., aqueous inks, oil-based paints, etc.). Printer 110 may comprise an inkjet printer that applies colored inks, such as Cyan (C), Magenta (M), Yellow (Y), Key (K) black, white, or colorless inks. One or more rollers 130 position web 120 as it travels through printing system 100. Printing system 100 may also include downstream devices such as a dryer 140 to dry ink applied to web 120.

Figure 2:
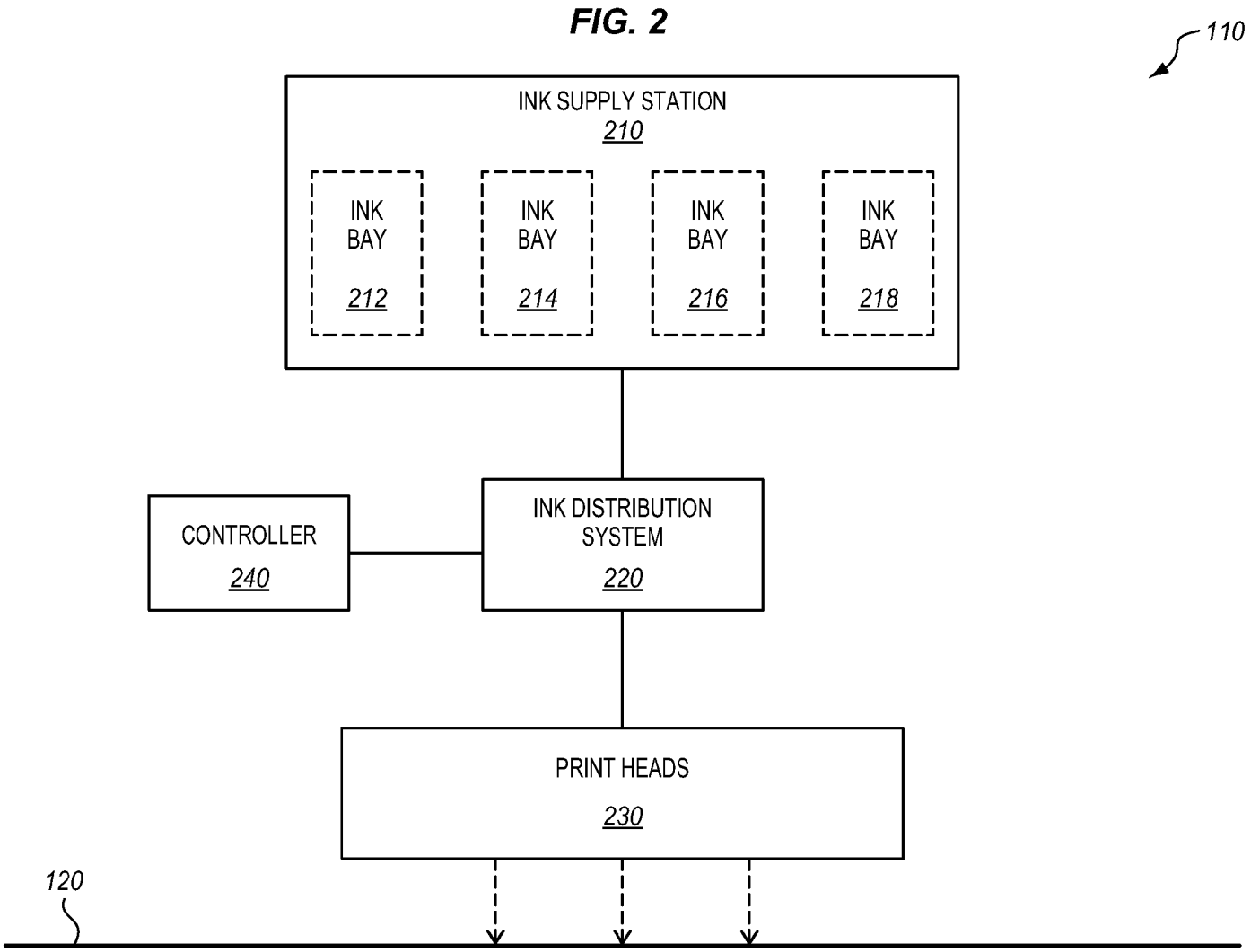
FIG. 2 is a block diagram of a printer in an exemplary embodiment.

FIG. 2 is a block diagram of a printer 110 in an exemplary embodiment. Printer 110 includes ink supply station 210, ink distribution system 220, printheads 230, and controller 240. Ink supply station 210 is configured to receive external supplies of ink and may comprise a stationary fixture of printer 110. Ink supply station 210 may include one or more ink bays 212-218 configured to transport a particular type or container of ink such as a cartridge or bag of ink into printer 110. Ink distribution system 220 is operable to transport ink from ink supply station 210 to one or more printheads 230. Ink distribution system 220 may also transport other types of fluids in printer 110, such as overcoat fluids, undercoat fluids, cleaning fluids, etc. Ink distribution system 220 may comprise flexible tubes, valves, pumps, etc. Printheads 230 are operable to eject ink onto media 120 for image formation. Controller 240 is any system or device operable to manage the supply of ink from ink supply station 210 to printheads 230 by directing one or more components of ink distribution system 220.

Figure 3:
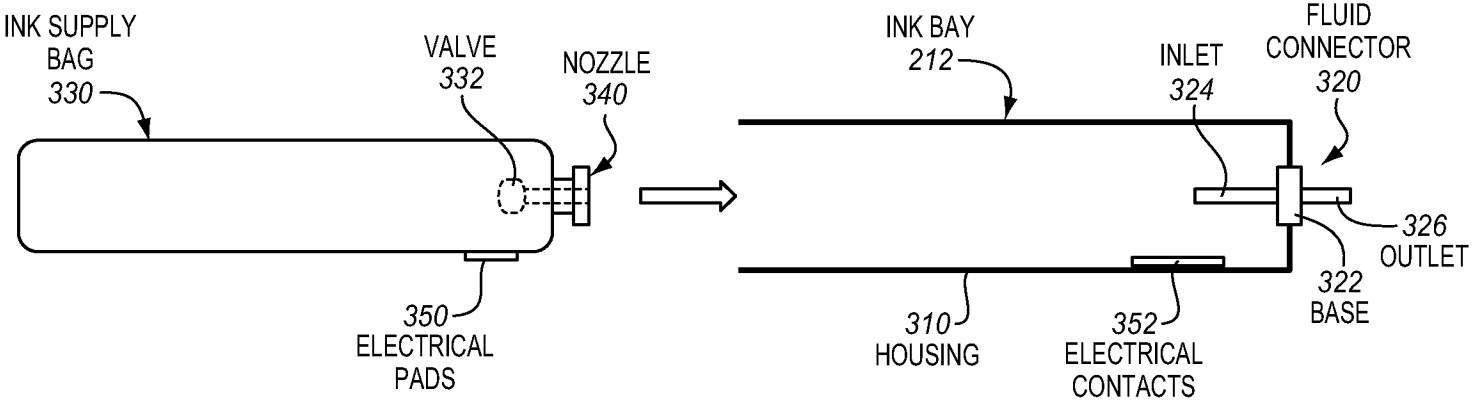
FIG. 3 illustrates an ink bay for receiving an ink supply bag in an exemplary embodiment.

FIG. 3 illustrates an ink bay 212 for receiving an ink supply bag in an exemplary embodiment. Ink bay 212 includes a housing 310 operable to support an external supply of ink, such as ink supply bag 330. Ink bay 212 also includes a fluid connector 320 operable to couple with a nozzle 340 of an ink supply bag 330 (or other types of fluid sources) for transferring fluid into printer 110. Fluid connector 320 includes a base 322, an inlet 324, and an outlet 326. Base 322 is stationary with respect to housing 310 or ink bay 212 and may be detachably coupled or fixed thereto. Inlet 324 protrudes from base 322 into housing 310 and is operable to receive ink from a nozzle 340 of ink supply bag 330. Outlet 326 protrudes from base 322 in the opposite direction and is operable to transport the ink to printheads 230 via ink distribution system 220.

Figure 4:
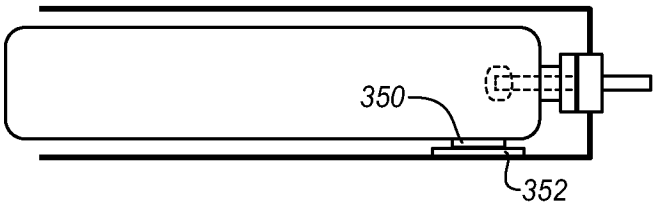
FIG. 4 illustrates an ink bay for receiving an ink supply bag in another exemplary embodiment.

FIG. 4 illustrates an ink bay for receiving an ink supply bag in another exemplary embodiment. As shown in FIGS. 3 and 4, ink bay 212 includes electrical contacts 352 and ink supply bag 330 includes electrical pads 350. Electrical contacts 352 and electrical pads 350 may have corresponding physical configurations so that an electrical connection is formed when the electrical contacts 352 and electrical pads 350 are aligned. Electrical contacts 340, and/or circuitry communicatively coupled thereto, may analyze the electrical connection to determine whether electrical pads 350 are properly aligned and/or to identify a property of ink supply bag 330. For example, electrical contacts 352 may determine a type of ink in ink supply bag 330 based on an electrical continuity of electrical pads 350 that identify the type of ink when electrical contacts 352 and electrical pads 350 align.

In FIG. 4, ink supply bag 330 is shown seated in housing 310 such that electrical pads 350 contact or align with electrical contacts 352. Furthermore, inlet 324 of fluid connector 320 enters nozzle 340 of ink supply bag 330 to contact a valve 332 of ink supply bag 330 to allow ink to flow from ink supply bag 330, through fluid connector 320, and to one or more printheads 230 via ink distribution system 220. In previous systems, electrical contacts 352 are disposed in ink bay 212 separately from fluid connector 320. That is, electrical pads 350 are typically located at a bottom corner of ink supply bag 330, or other areas apart from nozzle 340, and therefore electrical contacts 352 are disposed at a corresponding location in housing 310 of ink bay 212. In these configurations, electrical contacts 352 may confirm alignment with electrical contacts 350 even though there is not a proper connection between fluid connector 320 and nozzle 340 (e.g., due to bending of ink supply bag 330 and/or nozzle 340). An improperly coupled fluid connector 320 and nozzle 340 may allow air to be introduced into ink distribution system 220, which may result in hours of printer downtime to clean leaks and clear the channels of ink distribution system 220. Furthermore, since electrical contacts 352/electrical pads 350 and inlet 324/valve 332 may connect simultaneously, there may be a risk of contaminating connector 320 and/or fluid distribution system 220 with the wrong type of fluid or ink.

Figure 5:
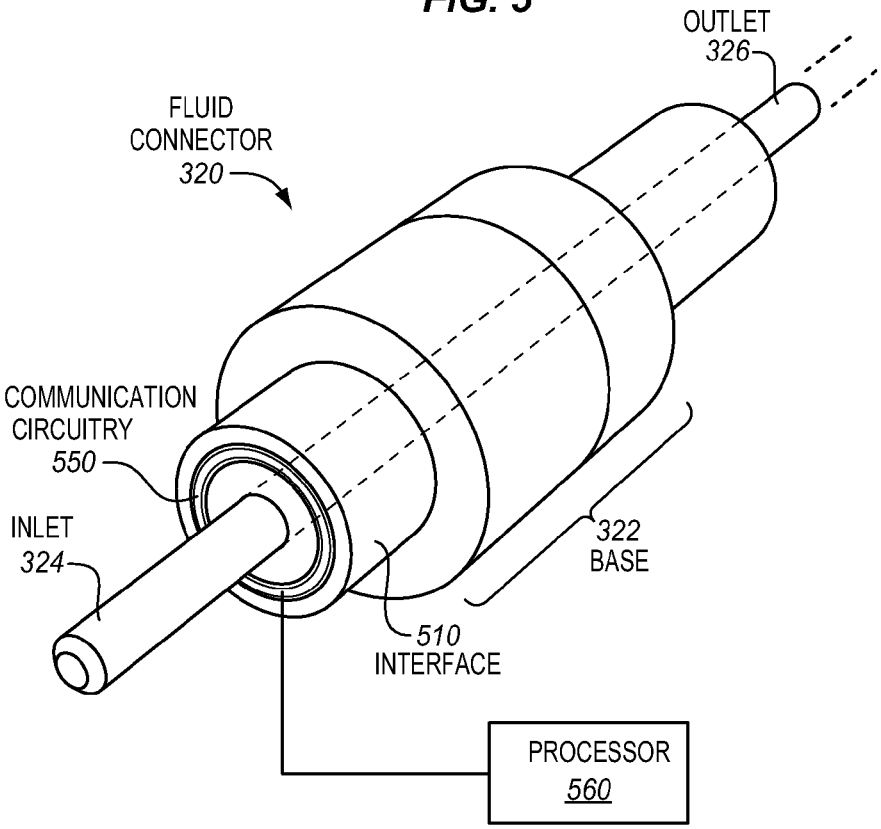
FIG. 5 illustrates a perspective view of a fluid connector in an exemplary embodiment.

Fluid connector 320 is therefore enhanced to ensure proper connection with ink supply bag 330 or other types of fluid sources. FIG. 5 illustrates a perspective view of a fluid connector 320 in an exemplary embodiment. Fluid connector 320 is enhanced to electronically confirm proper alignment and/or coupling with a fluid source. Fluid connector 320 includes interface 510 which comprises a body having at least one surface that includes communication circuitry 550. Communication circuitry 550 may include or be communicatively coupled with processor 560 configured to analyze a connection between communication circuitry 550 and a corresponding fluid source nozzle.

Figure 6:
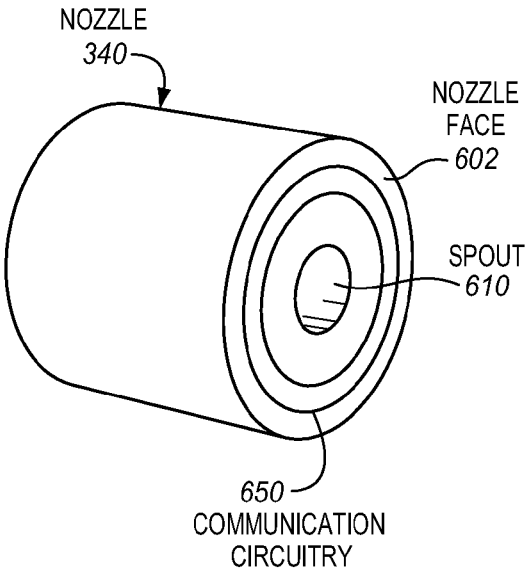
FIG. 6 illustrates a perspective view of a nozzle of a fluid source in an exemplary embodiment.

FIG. 6 illustrates a perspective view of a nozzle of a fluid source in an exemplary embodiment. Nozzle 340 may belong to ink supply bag 330 or any other type of fluid source and is enhanced to include communication circuitry 650 that correspond with communication circuitry 550 on interface 510. In one embodiment, communication circuitry 550/650 may each comprise one or more traces of conductive material disposed on respective surfaces of interface 510 and nozzle 340 in a corresponding physical formation or corresponding dimensions that contact and/or align to form an electrical connection. In another embodiment, communication circuitry 550/650 may each comprise near field communication (NFC) devices, such as radio frequency identification (RFID) devices, disposed on respective surfaces of interface 510 and nozzle 340 in a corresponding physical formation to establish a communication connection when communication circuitry 550/650 are in close proximity, contact, and/or alignment.

Fluid connector 320 and nozzle 340 may generally comprise corresponding physical features which enable coupling between fluid connector 320 and nozzle 340. As used herein, a coupling between fluid connector 320 and nozzle 340 refers to any type of physical connection that forms an airtight or substantially airtight seal around the area where fluid is transferred from nozzle 340 to fluid connector 320. For example, when fluid connector 320 is coupled with nozzle 340 of ink supply bag 330, ink may travel from the nozzle 340 through a hollow conduit in fluid connector 320 that extends through inlet 324, base 322, and outlet 326 without air being introduced into the flow of ink.

In general, the seal which couples nozzle 340 and fluid connector 320 and the connection between communication circuitry 550/650 may be formed in relative close proximity to one another. This proximity may enable processor 560 to accurately confirm whether nozzle 340 is properly aligned and/or coupled with fluid connector 320 based on the connection between communication circuitry 550/650. Thus, the proximity of the established connection and the established seal may help reduce or eliminate the possibility of air entering into the flow of fluid from nozzle 340 to fluid connector 320.

In one embodiment, communication circuitry 550/650 may be disposed on respective surfaces which are inside the seal formed when fluid connector 320 and nozzle 340 couple. The connection of communication circuitry 550/650 may be considered inside the seal or the point of coupling when the connection occurs in an airtight or substantially airtight environment as a result of the coupling. As such, processor 560 may confirm coupling of nozzle 340 to fluid connector 320 based on the connection since the physical configuration of fluid connector 320 and nozzle 340 ensures the formation of the seal occurs before or substantially simultaneous with the formation of the electrical connection.

For example, in addition to including communication circuitry 550/650, respectively, an end surface of interface 510 and nozzle face 602 may have a corresponding features that forms a seal when fluid connector 320 and nozzle 340 couple. The respective end surfaces may comprise flat, circular surfaces at the end of tubular bodies. Communication circuitry 650 on an end surface of nozzle 340 (e.g., nozzle face 602) may contact and/or come within close proximity to communication circuitry 550 on a corresponding end surface of interface 510. Additionally, end surfaces of interface 510 and nozzle face 602 may comprise corresponding physical features or materials operable to form a seal at the outer portions of respective end surfaces and around the electrical connection. As such, as nozzle 340 is pushed or otherwise coupled onto fluid connector 320 in the horizontal direction, a seal may be formed at the outer portions of the respective ends, and simultaneously or soon thereafter as nozzle 340 continues to be pushed, communication circuitry 550 and communication circuitry 650 establish a connection inside the seal.

Alternatively, interface 510 and/or nozzle 340 may have alternative shapes (e.g., non-circular ends, non-tubular bodies, etc.) or surface types (e.g., non-flat end surfaces) which correspond with one another to contact, align, or form a seal. For example, the body of interface 510 may overlap with the body of nozzle 340, or vice versa, in the horizontal direction to form a seal at the overlapping portion. Or, nozzle 340 may include a material that forms a seal with base 322. As such, nozzle 340 may be pushed onto fluid connector 320 to form a seal between respective bodies, and simultaneously or soon thereafter as nozzle 340 continues to be pushed, communication circuitry 550 and communication circuitry 650 contact or come within close proximity to form an electrical connection at the respective ends inside the seal.

In another embodiment, the connection between communication circuitry 550 and electrical pads 550 is formed outside the seal that is formed when fluid connector 320 and nozzle 340 couple. As such, processor 560 may be configured to confirm alignment of nozzle 340 to fluid connector 320 based on the connection. Here, the corresponding physical configuration of fluid connector 320 and nozzle 340 may ensure that the respective positions are in alignment such that the formation of the seal is established or impending.

For example, an end surface of interface 510 and nozzle face 602 may include communication circuitry 550 and communication circuitry 650, respectively, which contact and/or come within close proximity to establish a connection. Additionally, inlet 324 may extend from the end surface of interface 510 and may be configured to enter spout 610 of nozzle 340 to form a seal. The seal may be formed at the point where inlet 324 contacts a valve in spout 610 operable to dispense fluid. Alternatively or additionally, the seal may be formed between inlet 324 and a surface or material within spout 610, such as a rubber o-ring. In any case, the connection may form outside the formation of the seal. Additionally, the connection may be formed before, substantially simultaneous with, or after the formation of the seal.

Processor 560 may be configured to detect and/or validate the connection between communication circuitry 550/650 to confirm proper orientation, contact, alignment, and/or coupling of fluid connector 320 and nozzle 340. As used herein, the connection may refer to an electrical connection established by contact and/or alignment of conductive material or to a communication connection established by communication devices arranged within close proximity, in contact, and/or in alignment. If the fluid source may be of any orientation when coupled to fluid connector 320, communication circuitry 550/650 may be disposed on respective surfaces in an annular formation, such as one or more corresponding concentric circles. Thus, communication circuitry 550 may encircle inlet 324 and communication circuitry 650 may encircle spout 610 and the connection may confirm proper alignment and/or coupling of interface 510 and nozzle 340 regardless as to any respective orientation.

Alternatively, if the fluid source or nozzle 340 is to have a particular orientation when coupled to fluid connector 320, communication circuitry 550/650 may have a corresponding keyed configuration, such as corresponding non-circular shapes or designs. Thus, for this example, communication circuitry 550 and communication circuitry 650 may surround inlet 324 and spout 610, respectively, in a broken pattern or non-circular shape such that the connection may confirm proper alignment and/or coupling of interface 510 and nozzle 340 at a desired orientation, and confirm improper alignment and/or coupling of interface 510 and nozzle 340 when not aligned and/or coupled at the desired orientation.

Processor 560 may be additionally configured to validate a fluid source based on the connection. For example, processor 560 may be configured to receive or retrieve information related to a property of a coupled fluid source based on, or in response to, establishing a connection between communication circuitry 550/650. Processor 560 may also be coupled to one or more light-emitting diodes (LEDs), a graphical user interface (GUI), or other type of indicator of printer 110, ink supply station 210, or ink bay 212 to indicate to a user whether the connection is valid and/or whether the fluid source is valid. For example, processor 560 may determine that an ink bag in ink bay 212 is the incorrect color of ink for that ink bay 212 and direct a display that notifies an operator that the ink bag is invalid.

In one embodiment, processor 560 may be configured to determine a type of fluid associated with the fluid source (e.g., a type of ink in ink supply bag 330) based on an electrical continuity of communication circuitry 650 that identifies the type of fluid belonging to the fluid source when communication circuitry 550/650 contact and/or align. Processor 560 may further determine whether the fluid source is valid based on the identification of the fluid source. In another embodiment, communication circuitry 550 may comprise an RFID device, such as an active RFID transceiver and communication circuitry 650 may comprise a corresponding RFID device, such as a passive RFID tag. Communication circuitry 550 may be configured to detect and/or power circuitry 650 as well as receive/retrieve data therefrom when the devices are within a threshold distance from one another. Furthermore, communication circuitry 550 may validate the fluid source based on the establishment of communication and/or the received information.

Alternatively or additionally, communication circuitry 550 may be configured to collect and update information related to the fluid transfer between the fluid source and fluid connector 320. For example, the electrical connection or the communication connection between communication circuitry 550/650 may form a communication channel operable to transmit data related to fluid transfer, such as fluid type, amount fluid received/transmitted, serial number, lot number, etc. Additional examples of fluid transfer information include, but is not limited to, amount of ink remaining in the ink container, consumptions rates, time records of installation and/or removal of the ink container based on when the electrical connection is formed/broken, etc. Processor 560 and/or communication circuitry 550/650 may be communicatively coupled to memory from which data related to fluid transfer may be exchanged and/or stored.

In an alternative embodiment, radio frequency identification devices located at corresponding locations of ink bay 212 and a fluid container, such as fluid supply bag 330, may be communicatively coupled with processor 560, communication circuitry 550, communication circuitry 650, and/or memory, and may be configured to exchange data in response an electrical connection formed between communication circuitry 550 and communication circuitry 650. For example, an RFID read/write device attached to ink supply bag 330 may store information regarding the supply of ink, and an RFID read/write device disposed on or in ink supply station 210 or an ink bay 212.

To further reduce the possibility of contaminating fluid connector 320 and/or ink distribution system 220 with the wrong type of fluid, fluid connector 320 may be further enhanced to prevent fluid connector 320 from receiving fluid from a fluid source based on a determination that the electrical connection and/or the fluid source is invalid. Alternatively or additionally, fluid connector 320 may prevent nozzle 340 from coupling to fluid connector 320 based on a determination that the electrical connection and/or the fluid source is invalid.

Figure 7:
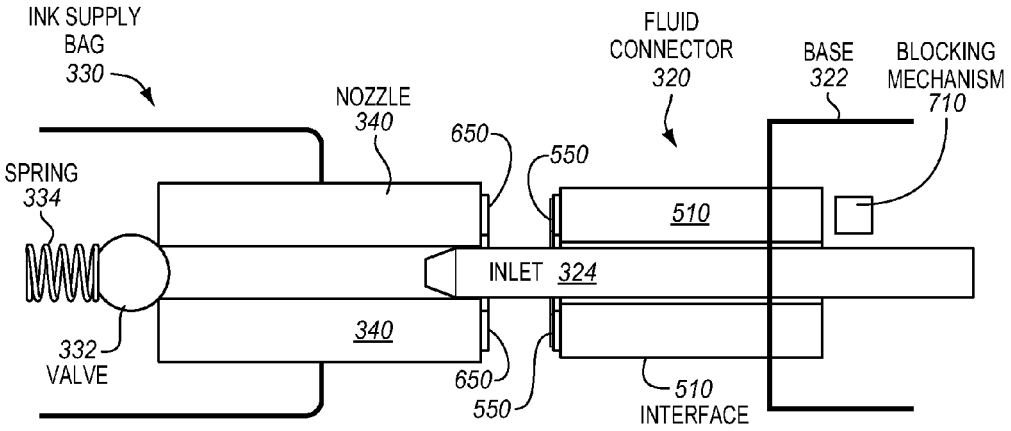
FIG. 7 illustrates a cross-sectional view of a fluid source and a fluid connector in the process of aligning in an exemplary embodiment

FIG. 7 illustrates a cross-sectional view of a fluid source and a fluid connector in the process of aligning in an exemplary embodiment. During the process of aligning and/or coupling, fluid connector 320 and/or nozzle 340 may be moved closer with respect to one another in what is referred to herein as a horizontal direction for purposes of discussion. Base 322 may be stationary with respect to the horizontal direction (e.g., fixed or coupled with respect to housing 310 or ink bay 212). Prior to alignment and/or coupling of fluid connector 320 and nozzle 340, interface 510 may protrude from base 322 in what is referred to as a forward horizontal direction. Additionally, inlet 324 may protrude from an end surface of interface 510 for a length in the forward horizontal direction. Thus, in the process of aligning and/or coupling, inlet 324 may enter opening of spout 610 prior to formation of a connection between communication circuitry 550/650 as shown in FIG. 7.

Fluid connector 320 may additionally include a blocking mechanism 710 which is any system, device, or apparatus operable to prevent fluid connector 320 from receiving ink from a fluid source (e.g., ink supply bag 330). Furthermore, processor 560 (not shown in FIGS. 7-9) may be configured to direct movement of the blocking mechanism 710 based on a validation of the connection and/or fluid source. For example, processor 560 may be communicatively coupled to a movement mechanism (e.g., a mechanical, electrical, and/or electromechanical system or device) to direct movement of blocking mechanism 710 which comprises a physical object or interference that is movable between a blocking position and a non-blocking position.

Figure 8:
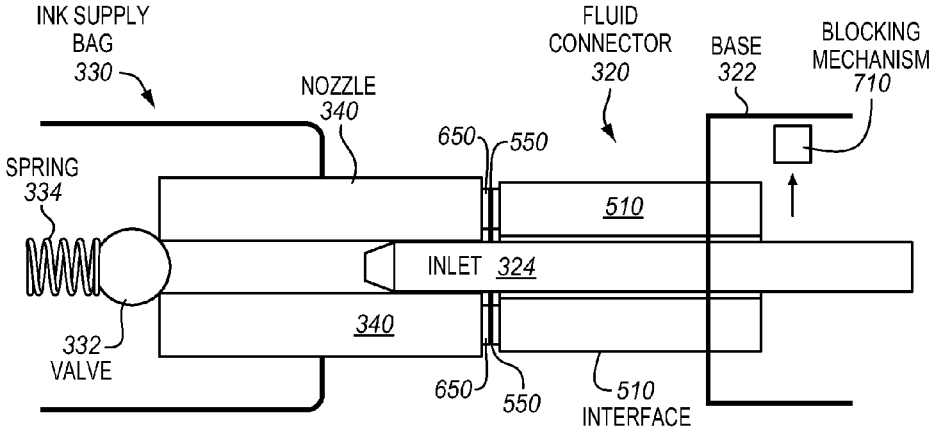
FIG. 8 illustrates a cross-sectional view of a fluid source and a fluid connector aligned and/or coupled in an exemplary embodiment.
Figure 9:
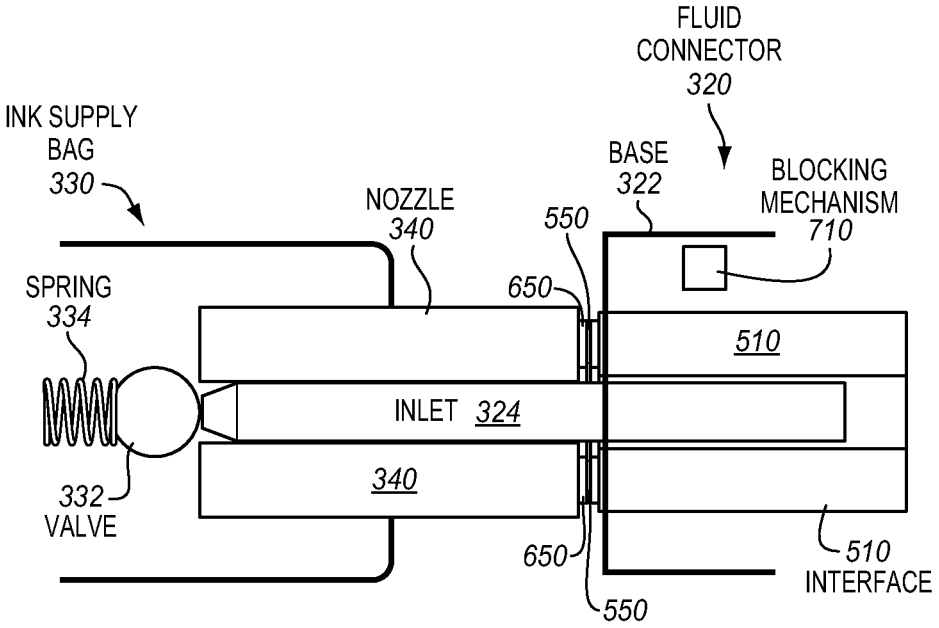
FIG. 9 illustrates a cross-sectional view of a fluid connector receiving fluid from a fluid source in an exemplary embodiment.

In the exemplary embodiments of FIGS. 7-9, interface 510 is configured to move, or retract, into base 322 in the horizontal direction, and blocking mechanism 710 is an object that is configured to interfere with the retraction of interface 510. Before a connection between communication circuitry 550/650 is established, blocking mechanism 710 may be positioned in base 322 behind interface 510 in a blocking position to prevent retraction of interface 510 into base 322 in a reverse horizontal direction.

As nozzle 340 and/or fluid connector 320 continue to move together in the horizontal direction, alignment and/or coupling of nozzle 340 and fluid connector 320 may occur. FIG. 8 illustrates a cross-sectional view of a fluid source and a fluid connector aligned and/or coupled in an exemplary embodiment. Processor 560 may detect the connection between communication circuitry 550/650 when the fluid source (e.g., ink supply bag 330) and fluid connector 320 align and/or couple. Processor 560 may further analyze the connection to determine whether the fluid source is valid or invalid. For example, in response to establishing the connection between communication circuitry 550/650, processor 560 may receive information regarding the fluid source and use that information to validate or invalidate the fluid source.

In the exemplary embodiments of FIGS. 7-9, when blocking mechanism 710 is in the blocking position, a body of interface 510 extends or protrudes from base 322. Additionally, inlet 324 comprises a body length that further extends from the end surface of the extended interface 510 for a first length that is shorter than the length for contacting the fluid dispensing mechanism in nozzle 340, which in this example is formed by valve 332 and spring 334. Alternatively or additionally, inlet 324 may comprise a body length such that its protrusion length from an extended interface 510 is shorter than the length for coupling inside spout 610. Thus, processor 560 may validate the connection and/or fluid source before inlet 324 is able to receive fluid from and/or couple with the fluid source to prevent fluid contamination.

In response to a determination that the connection and/or fluid source is invalid, processor 560 may direct an appropriate notification to a user. Processor 560 may also be configured to direct blocking mechanism 710 to remain and/or return to the blocking position in response to a determination that the connection and/or fluid source is invalid or in response that to a determination that the connection is not established or has been broken.

In response to a determination that the connection and/or fluid source is valid, processor 560 may direct blocking mechanism 710 to move to a position that allows retraction of interface 510. Alternatively or additionally, processor 560 may notify a user that the connection and/or fluid source is valid such that blocking mechanism 710 may be moved manually to a non-blocking position. When in the non-blocking position, blocking mechanism 710 is clear of the horizontal sliding path of interface 510. For instance, blocking mechanism 710 may be removed from base 322 or moved vertically in base 322 to allow retraction of interface 510 into base 322.

FIG. 9 illustrates a cross-sectional view of a fluid connector receiving fluid from a fluid source in an exemplary embodiment. With blocking mechanism 710 removed from the horizontal sliding path of interface 510, nozzle 340 may be pushed in the horizontal direction to cause interface 510 to retract into base 322. Processor 560 may direct a notification to indicate that refraction of interface 510 is allowed in response to validation and/or movement of blocking mechanism 710 to a non-blocking position.

In the exemplary embodiments of FIGS. 7-9, inlet 324 may be fixed or stationary in fluid connector 320 with respect to the horizontal direction such that the protrusion length of inlet 324 from interface 510 is increased by an amount the corresponds with the amount of retraction of interface 510 into base 322. Thus, as interface 510 retracts, inlet 324 may travel further down a length of spout 610 and eventually contact valve 332 to compress spring 334 or otherwise contact the dispensing mechanism of the fluid source to receive the fluid. In other words, the conduit of nozzle 340 may generally have a corresponding length which allows inlet 324 to contact its fluid dispensing mechanism for ink flow when interface 510 is in the retracted position. Fluid connector 320 may thus, for example, confirm proper connection to ink supply bag 330 as well as validate its ink type before allowing any ink flow to occur.

It will be appreciated that various extended/retracted positions of interface 510 are possible, depending on the respective lengths of inlet 324, interface 510, conduit of spout 610 to valve 332, and nozzle 340. For example, interface 510 may retract to be substantially flush with base 322 when blocking mechanism 710 is removed from the blocking position or may retract an alternative length with respect to base 322. Additionally, blocking mechanism 710 may also be configured to prevent ink from flowing from the fluid source to fluid connector 320 in alternative configurations. For example, processor 560 may direct blocking mechanism 710 to open/close the channel of fluid connector 320 that receives fluid from the fluid source based on the validation. Alternatively or additionally, blocking mechanism 710 may prevent inlet 324 from receiving ink from ink supply bag 330 with a mechanism in ink bay 212 external to fluid connector 320. Further, blocking mechanism 710 may comprise other types of interference that prevent/allow retraction of interface 510 such as magnetic interference.

Although specific embodiments were described herein, the scope of the inventive concepts is not limited to those specific embodiments. The scope of the inventive concepts is defined by the following claims and any equivalents thereof.

We claim:

1. An apparatus comprising:

a fluid supply station of a printer comprising:

a connector configured to couple with a fluid source for supplying fluid to at least one printhead of the printer, the connector comprising:

an interface having a body with an end surface that corresponds with a face of a nozzle of the fluid source;

an inlet protruding from the end surface and configured to enter an opening of the nozzle for receiving the fluid from the fluid source; and communication circuitry disposed on the end surface and configured to establish a connection with corresponding communication circuitry disposed on the face of the nozzle of the fluid source;

wherein the communication circuitry establishes the connection inside a seal that is formed when the fluid source couples with the connector; and wherein the seal prevents air from entering a flow of fluid from the fluid source to the connector.

2. The apparatus of claim 1 further comprising:

a processor configured to analyze the connection, and to validate the fluid source based on the connection.

3. The apparatus of claim 2 further comprising:

a blocking mechanism communicatively coupled to the processor and configured to move to a first position to prevent the interface from retracting into the connector, and to move to a second position to allow the interface to retract into the connector;

wherein, in response to a determination that the fluid source is valid, the processor is configured to direct the blocking mechanism to move to the second position to allow the interface to retract into the base of the connector so that the inlet contacts a valve in the nozzle and receives the fluid from the fluid source.

4. The apparatus of claim 3 wherein:

when the blocking mechanism is in the first position:

the interface protrudes from a base of the connector in a forward horizontal direction;

the inlet protrudes from the end surface in the forward horizontal direction for a first length; and the blocking mechanism is disposed in the base behind the interface to prevent the interface from retracting into the base along a path in a reverse horizontal direction.

5. The apparatus of claim 4 wherein:

when the blocking mechanism is in the second position:

the interface is able to retract into the base in the reverse horizontal direction;

the inlet protrudes from the end surface in the forward horizontal direction for a second length that is longer than the first length by an amount that corresponds with an amount of retraction of the interface into the base; and the blocking mechanism is positioned in a vertical direction away from the path to allow the interface to retract into the base in the reverse horizontal direction.

6. The apparatus of claim 5 wherein:

the first length is shorter than a distance from an entrance of the opening in the nozzle to the valve in the nozzle operable to release the fluid from the fluid source such that when the inlet protrudes from the interface for the first length the inlet enters the nozzle but does not contact the valve to release the fluid; and the second length exceeds the distance from the entrance of the opening of the nozzle to the valve in the nozzle such that when the inlet protrudes from the interface for the second length the inlet enters the nozzle and contacts the valve to cause the fluid to flow from the nozzle into the connector.

7. The apparatus of claim 1 wherein:

the communication circuitry comprises conductive material configured to establish an electrical connection with corresponding conductive material disposed on the face of the nozzle of the fluid source.

8. The apparatus of claim 7 wherein:

the electrical connection is established when the inlet enters a spout and the end surface and the nozzle face align to cause the conductive material to contact the corresponding conductive material.

9. The apparatus of claim 1 wherein:

the communication circuitry comprises a radio frequency identification (RFID) transceiver configured to establish a communication connection with a corresponding RFID tag disposed on the face of the nozzle of the fluid source.

10. The apparatus of claim 9 further comprising:

the communication connection is established when the inlet enters the spout and the end surface and the nozzle face are within a threshold distance.

11. A fluid connector comprising:

a tubular body configured to slide with respect to a fixed base;

a blocking mechanism configured to move between a first position in the base behind the tubular body to prevent the tubular body from sliding, and a second position that allows the tubular body to slide into the base;

an end on one side of the tubular body;

an inlet extending from the end and configured to enter a nozzle of a fluid source for receiving fluid into the fluid connector;

communication circuitry disposed on the end around the inlet and configured to connect to corresponding communication circuitry disposed on an opposing surface of the fluid source; and a processor coupled to the communication circuitry and configured to direct movement of the blocking mechanism based on the connection.

12. The fluid connector of claim 11 further comprising:

the communication circuitry comprises conductive material disposed on the end of the tubular body and the corresponding communication circuitry comprises conductive material disposed on the opposing surface of the fluid source;

the communication circuitry and the corresponding communication circuitry are configured to contact to form the electrical connection when or after the fluid source couples to the fluid connector; and the processor is configured to confirm coupling of the fluid source and fluid connector based on the electrical connection.

13. The fluid connector of claim 12 wherein:

the fluid source is coupled to the fluid connector when an airtight seal is formed between the tubular body and the fluid source; and the electrical connection between the electrical contacts and the electrical pads is formed on or inside the seal.

14. The fluid connector of claim 11 wherein:

the communication circuitry comprises an radio frequency identification (RFID) transceiver disposed on the end of the tubular body and the corresponding communication circuitry comprises an RFID tag disposed on the opposing surface of the fluid source;

the communication circuitry and the corresponding communication circuitry are configured to establish a communication channel when or after the fluid source couples to the fluid connector; and the processor is configured to confirm coupling of the fluid source and fluid connector based on the establishment of the communication channel.

15. A system comprising:

a fluid source configured to dispense fluid, the fluid source including a nozzle, a valve configured to dispense the fluid from an opening in the nozzle, and first communication circuitry disposed on a face of the nozzle around the opening; and a connector that is configured to receive the dispensed fluid from the fluid source, the connector including a body with a coupling end configured to couple with the fluid source to form a seal, second communication circuitry disposed on the coupling end that correspond with the first communication circuitry on the face of the nozzle, and an inlet that protrudes from the connector and configured to receive the fluid from the opening of the nozzle;

wherein the connector includes a processor configured to validate the fluid source in response to establishing a connection between the first communication circuitry and the second communication circuitry, and to enable the inlet to contact the valve in the nozzle to receive the fluid from the fluid source in response to the validation.

16. A system of claim 15 wherein:

the first communication circuitry comprises a radio frequency identification (RFID) tag disposed on the face of the nozzle around the opening, and the second communication circuitry comprises an RFID transceiver disposed on the coupling end of the connector.

17. A system of claim 15 wherein:

the first communication circuitry comprises conductive material disposed on the face of the nozzle around the opening, and the second communication circuitry comprises corresponding conductive material disposed on the coupling end of the connector.

18. A system of claim 15 wherein:

the connection between the first communication circuitry and the second communication circuitry occurs after formation of the seal.

19. A system of claim 15 wherein:

the processor is communicatively coupled to a blocking mechanism configured to selectively allow the inlet to contact the valve in the nozzle to receive the fluid from the fluid source in response to the validation.

* * * * *